US011069318B2

(12) United States Patent
Liao

(10) Patent No.: US 11,069,318 B2
(45) Date of Patent: Jul. 20, 2021

(54) DRIVING CIRCUIT FOR DISPLAY PANEL

(75) Inventor: Min-Nan Liao, Hsinchu County (TW)

(73) Assignee: SITRONIX TECHNOLOGY CORP., Hsinchu County (TW)

( * ) Notice: Subject to any disclaimer, the term of this patent is extended or adjusted under 35 U.S.C. 154(b) by 0 days.

(21) Appl. No.: 14/113,609

(22) PCT Filed: Jul. 1, 2011

(86) PCT No.: PCT/CN2011/001089
§ 371 (c)(1),
(2), (4) Date: Oct. 24, 2013

(87) PCT Pub. No.: WO2013/003975
PCT Pub. Date: Jan. 10, 2013

(65) Prior Publication Data
US 2014/0049459 A1 Feb. 20, 2014

(51) Int. Cl.
*G09G 3/36* (2006.01)

(52) U.S. Cl.
CPC ..... *G09G 3/3696* (2013.01); *G09G 3/3688* (2013.01); *G09G 2310/027* (2013.01); *G09G 2310/0291* (2013.01); *G09G 2320/0276* (2013.01); *G09G 2330/02* (2013.01)

(58) Field of Classification Search
CPC ..... G09G 3/3696; G09G 3/3688; G09G 2310/027; G09G 2330/02; G09G 2320/0276; G09G 2310/0291; B60L 2210/14
USPC ..... 345/90
See application file for complete search history.

(56) References Cited

U.S. PATENT DOCUMENTS

2003/0122766 A1* 7/2003 Pulvirenti ..... 345/95
2005/0200622 A1* 9/2005 Yajima ..... 345/211
2006/0132417 A1* 6/2006 Shigenobu et al. ..... 345/98
2006/0267901 A1 11/2006 Maekawa
2006/0284806 A1* 12/2006 Maki ..... 345/89
2007/0000971 A1* 1/2007 Kumagai ..... G09G 3/3688 228/101
2007/0268232 A1* 11/2007 Ku et al. ..... 345/100
(Continued)

FOREIGN PATENT DOCUMENTS

CN 1645728 A 7/2005
CN 101814265 A 8/2010
(Continued)

*Primary Examiner* — Premal R Patel
(74) *Attorney, Agent, or Firm* — WPAT, PC

(57) ABSTRACT

The present invention relates to an area-saving driving circuit for a display panel, which includes a plurality of digital-to-analog converting circuits convert input data, respectively, and produce a pixel signal. A plurality of driving units are coupled to the plurality of digital-to-analog converting circuits, respectively. They produce a driving signal according to the pixel signal and transmit the driving signal to the display panel for displaying. A plurality of voltage booster units are coupled to the plurality of driving units, respectively, and produce a supply voltage according to a control signal. Then the supply voltage is provided to the plurality of driving units. Thereby, by providing the supply voltage to the plurality of driving units of the display panel through the use of the plurality of voltage booster units, the area of the external storage capacitor is reduced or eliminated.

11 Claims, 9 Drawing Sheets

(56) References Cited

U.S. PATENT DOCUMENTS

| | | | | |
|---|---|---|---|---|
| 2008/0036529 | A1* | 2/2008 | Ishiyama | 327/536 |
| 2008/0084410 | A1* | 4/2008 | Uehara | 345/211 |
| 2008/0122812 | A1* | 5/2008 | Park | G09G 3/3648 345/204 |
| 2009/0079495 | A1* | 3/2009 | Morita | 327/538 |
| 2010/0097361 | A1* | 4/2010 | Oku | G09G 3/3655 345/209 |
| 2011/0032233 | A1* | 2/2011 | Nishimura | H03F 3/3022 345/211 |
| 2012/0140563 | A1* | 6/2012 | Sung | G06F 1/10 365/185.18 |
| 2012/0218049 | A1* | 8/2012 | Sawada | H03L 7/07 331/25 |

FOREIGN PATENT DOCUMENTS

| | | | |
|---|---|---|---|
| CN | 102063885 | A | 5/2011 |
| JP | 2003-216127 | | 7/2003 |
| JP | 2004-187152 | | 7/2004 |
| JP | 2006-338139 | | 12/2006 |
| JP | 2008-209901 | | 9/2008 |
| JP | 2008-292926 | | 12/2008 |
| JP | 2008-292926 | A | 12/2008 |
| JP | 2010-026138 | | 2/2010 |
| KR | 10-2004-0009573 | A | 1/2004 |
| KR | 10-1023346 | B1 | 3/2011 |
| TW | 501081 | B | 9/2002 |
| TW | 201035945 | A | 10/2010 |

* cited by examiner

DRIVING CIRCUIT FOR DISPLAY PANEL

FIELD OF THE INVENTION

The present invention relates generally to a driving circuit, and particularly to an area-saving driving circuit for a display panel.

BACKGROUND OF THE INVENTION

Modern technologies are developed prosperously. New information products are provided daily for satisfying people's various needs. The majority of early displays are cathode ray tubes (CRTs). Due to their huge size and power consumption as well as harmful radiation for long-term users, they are gradually replaced by liquid crystal displays (LCDs) at present. LCDs own the advantages of lightweight, small size, low radiation, and low power consumption. Thereby, they have become the mainstream in the market.

In addition, thanks to the rapid progress in the manufacturing technologies of panels in recent years, the manufacturing costs of touch panels has reduced significantly, making them widely applied to general consumer electronic products, such as the small-sized electronic appliances including mobile phones, digital cameras, digital music players (MP3), personal digital assistants (PDAs), and global positioning system (GPS). In these electronic commodities, touch panels are equipped and used as the displays and provides interactive input operations for users. Thereby, the friendliness of the human-machine interface is improved greatly and the input efficiency is enhanced.

In order to provide a larger range of power supply, such as 2.3V to 4.6V, for single-power applications as well as shrinking the area of the driving chips used for driving display panels, driving methods that can satisfy both requirements are proposed. The source driver of a general display device adopts operational amplifiers (Op-amps) or resistive voltage dividing for driving the display panel. Moreover, for making the housing smaller and easier to collocate, raising assembly yield, and reducing costs, shrinking external devices has become an important trend for single-chip liquid-crystal driving chip modules.

FIG. 1 shows a driving circuit for a display panel according to prior art. As shown in the figure, the driving circuit 1' comprises a plurality of digital-to-analog converting circuits 10' and a plurality of driving units 20'. The plurality of digital-to-analog converting circuits 10' receive input pixel data, respectively, and convert the input pixel data to a pixel signal. Then they transmit the pixel signal to the driving units 20' for producing a driving signal. The driving units 20' transmit the driving signal to the display panel 2' for displaying. The driving circuit 1' according to the prior art is connected externally to a voltage booster circuit 30'. For maintaining the level of the output signals of the digital-to-analog converting circuit 10', the voltage booster circuit 30' needs to couple to a storage capacitor 40'. Nonetheless, the capacitance of the storage capacitor 40' needs to be large (about 0.1 uF). Thereby, the storage capacitor 40' needs to adopt an external capacitor, which increases the manufacturing cost. If the storage capacitor 40' is disposed in the driving circuit 1', the area of the driving circuit 1' is increased.

Accordingly, the present invention provides a novel area-saving driving circuit for a display panel, which can shrink the area of the storage capacitor connected externally to the driving circuit. Alternatively, the external storage capacitor is even not required. Hence, the problems described above can be solved.

SUMMARY

An objective of the present invention is to provide an area-saving driving circuit for a display panel, which uses a plurality of voltage booster units to provide a supply voltage, respectively, to a plurality of driving units of a display panel for shrinking the area of the external storage capacitor. Alternative, the external storage capacitor can be even not required. Thereby, the purpose of saving circuit area can be achieved.

The area-saving driving circuit for a display panel according to the present invention comprises a plurality of digital-to-analog converting circuits, a plurality of driving units, and a plurality of voltage booster units. The plurality of digital-to-analog converting circuits convert input data, respectively, and produce a pixel signal. The plurality of driving units are coupled to the plurality of digital-to-analog converting circuits, respectively. They produce a driving signal according to the pixel signal and transmit the driving signal to the display panel for displaying. In addition, the plurality of voltage booster units are coupled to the plurality of driving units, respectively, and produce a supply voltage according to a control signal. Then the supply voltage is provided to the plurality of driving units. Thereby, by providing the supply voltage to the plurality of driving units of the display panel by means of the plurality of voltage booster units, the area of the external storage capacitor is reduced. Alternative, the external storage capacitor can be even not required. Hence, the purpose of saving circuit area can be achieved.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
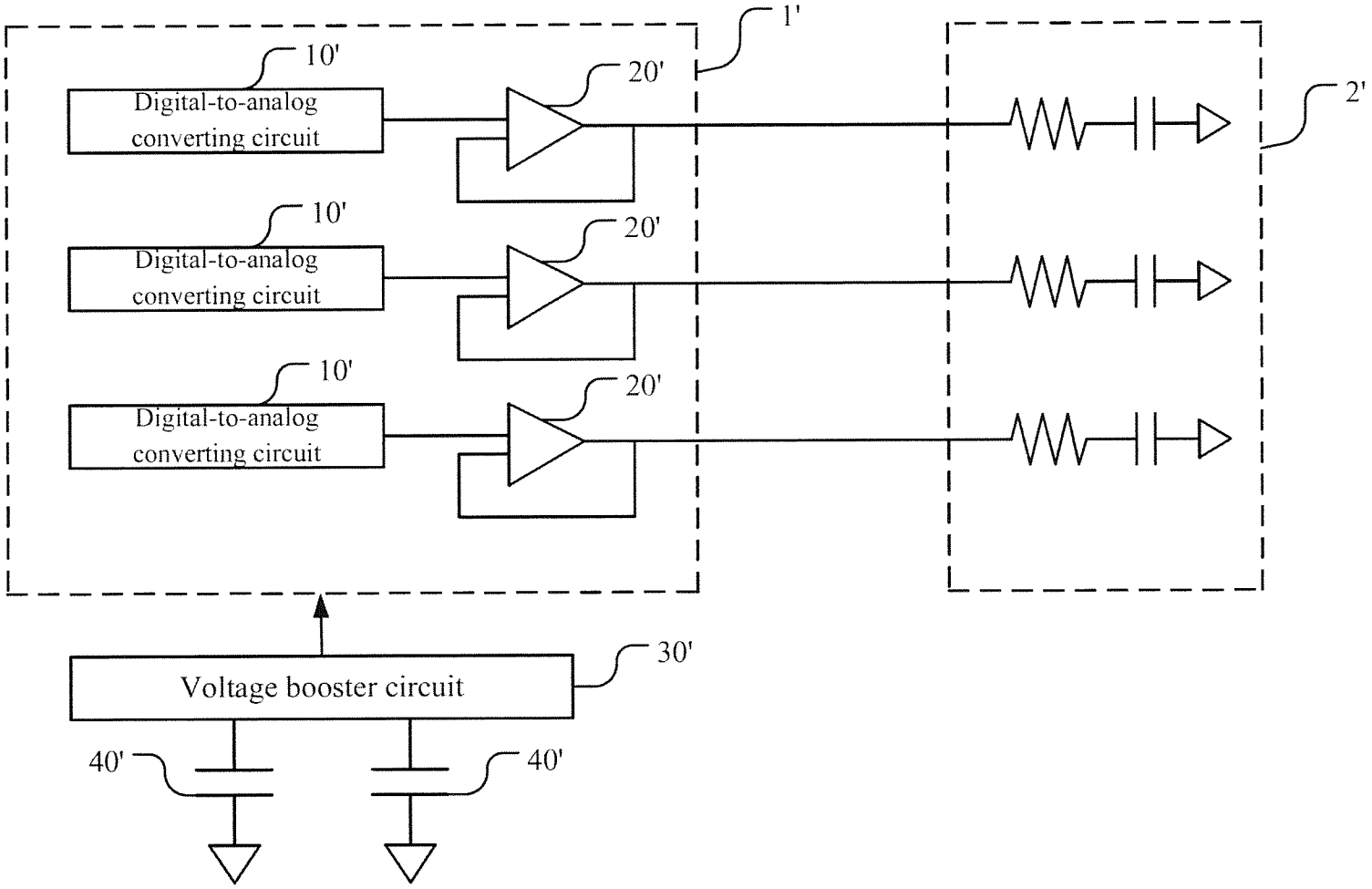
Figure 1 (Prior art)
FIG. 1 shows a driving circuit for a display panel according to prior art.
Figure 2:
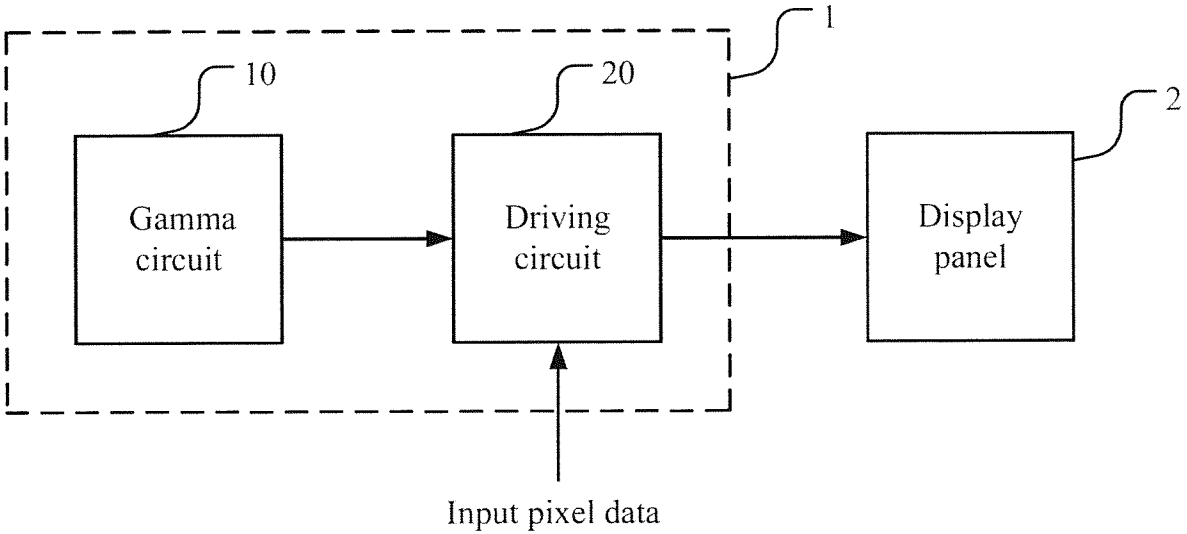
FIG. 2 shows a block diagram of the source driver according a preferred embodiment of the present invention.

FIG. 2 shows a block diagram of the source driver according a preferred embodiment of the present invention. As shown in the figure, the source driver 1 comprises a Gamma circuit 10 and a driving circuit 20. The Gamma circuit 10 produces a plurality of input signals according to a Gamma curve. The plurality of input signals are voltage signals having difference levels. The Gamma circuit 10 transmits the plurality of input signals to the driving circuit 20, which produces a plurality of driving signals, respectively, according to a plurality of input pixel data and the plurality of input signals. Then the driving circuit 20 transmits the plurality of driving signals to a display panel 2 for driving the display panel 2 to display.

Figure 3:
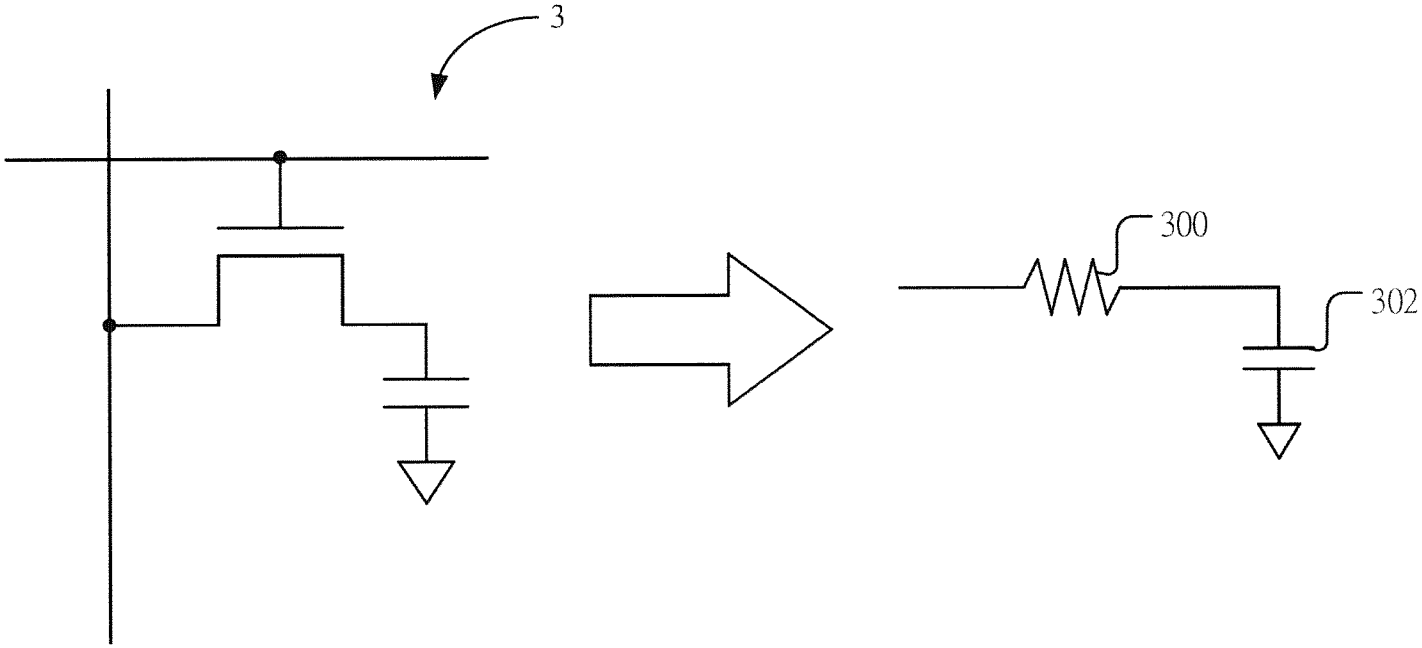
FIG. 3 shows the equivalent circuit for parasitic RC of the source line of the display panel according to the present invention.
Figure 4:
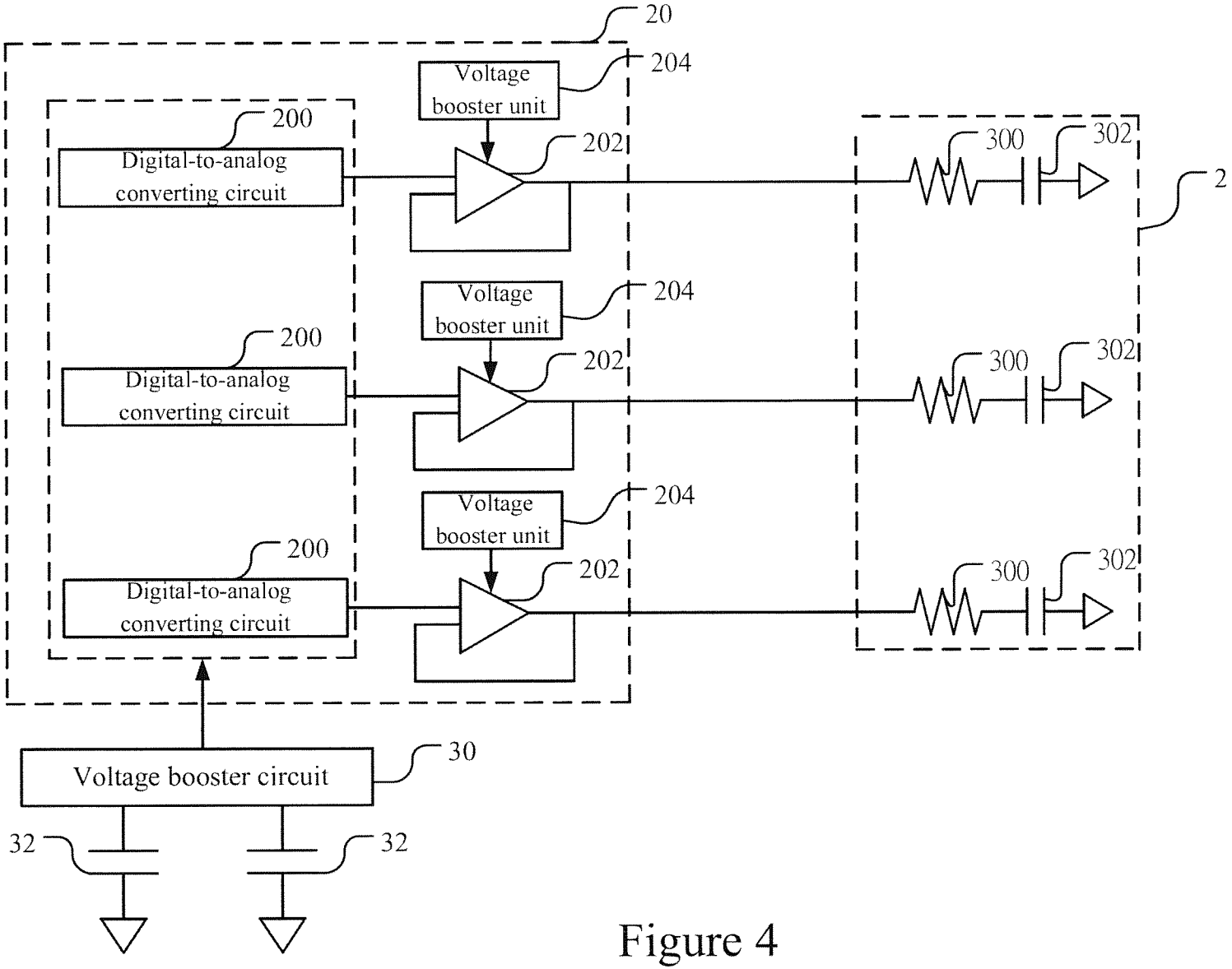
FIG. 4 shows a circuit diagram of the driving circuit according to a preferred embodiment of the present invention.

In addition, FIG. 3 shows the equivalent circuit for parasitic RC of the source line of the display panel according to the present invention. As shown in the figure, the display panel 2 according to the preferred embodiment of the present invention is a thin-film transistor liquid crystal display (TFT-LCD). The display panel 2 comprises a plurality of pixel structures 3, which are coupled to a plurality of driving units 202 of the driving circuit 20 (as shown in FIG. 4), respectively. Each pixel structure 3 on the source line of the display panel 2 is a thin-film transistor (TFT), and is equivalent to a resistor 300 connected in series with a capacitor 302. This is well known to a person having ordinary skill in the art, and hence will not be described in more details.

FIG. 4 shows a circuit diagram of the driving circuit according to a preferred embodiment of the present invention. As shown in the figure, the area-saving driving circuit 20 for a display panel according to the present invention comprises a plurality of digital-to-analog converting circuits 200, a plurality of driving units 202, and a plurality of voltage booster units 204. The plurality of digital-to-analog converting circuits 200 convert the input pixel data to a pixel signal, respectively. The plurality driving units 202 are coupled to the plurality of digital-to-analog converting circuits 200, respectively. The plurality of driving units 202 produce a driving signal according to the pixel signal and transmit the driving signal to the display panel 2 for displaying. According to the present embodiment, the plurality of driving units 202 amplify the pixel signals output by the digital-to-analog converting circuit 200 for producing the driving signals. The plurality of voltage booster units 204 are coupled to the plurality of driving units 202, respectively, and produce a supply voltage according to a control signal. Besides, the plurality of voltage booster units 204 provide the plurality of supply voltages to the plurality of driving units 202, respectively, so that the plurality of driving units 202 can produce the driving signals for driving the display panel 2 to display. The plurality of driving units 202 are Op-amps. According to the present invention, the plurality of voltage booster units 204 provide supply voltages to the plurality of driving units 202 of the display panel 2, respectively. Thereby, the area of the external storage capacitor is shrunk. Alternatively, the external storage capacitor can be not required. The purpose of saving circuit area is thus achieved. The control signals received by the plurality of driving units 202 can be generated by any control circuit inside the display panel 2 and transmitted to the plurality of voltage booster units 204. This is well known to a person having ordinary skill in the art, and hence will not be described in more details.

Moreover, the area-saving driving circuit 20 for a display panel is further coupled to a voltage booster circuit 30, which is coupled to the plurality of digital-to-analog converting circuits 200 and provides the supply voltage to the plurality of digital-to-analog converting circuits 200. In addition, the voltage booster circuit 30 is further coupled to a storage capacitor 32 for stabilizing the supply voltage output by the voltage booster circuit 30. Nonetheless, because the plurality of driving units 202 consumes most power of the driving circuit 20, the capacitance of the storage capacitor 32 required by the voltage booster circuit 30 can be significantly smaller. Thereby, the area of the storage capacitor 32 is shrunk greatly, and hence achieving the purpose of saving the circuit area of the driving circuit 20. According to the present invention, more than 50% of the area of the display panel 2 can be saved.

Besides, according to the present invention, because the plurality of voltage booster units 204 provide supply voltage to the plurality of driving units 202 of the display panel, respectively, the area for the storage capacitor can be saved significantly or even no storage capacitor is required. Thereby, the voltage booster circuit 30 can be disposed in the driving circuit 20 (not shown in the figure).

Figure 5:
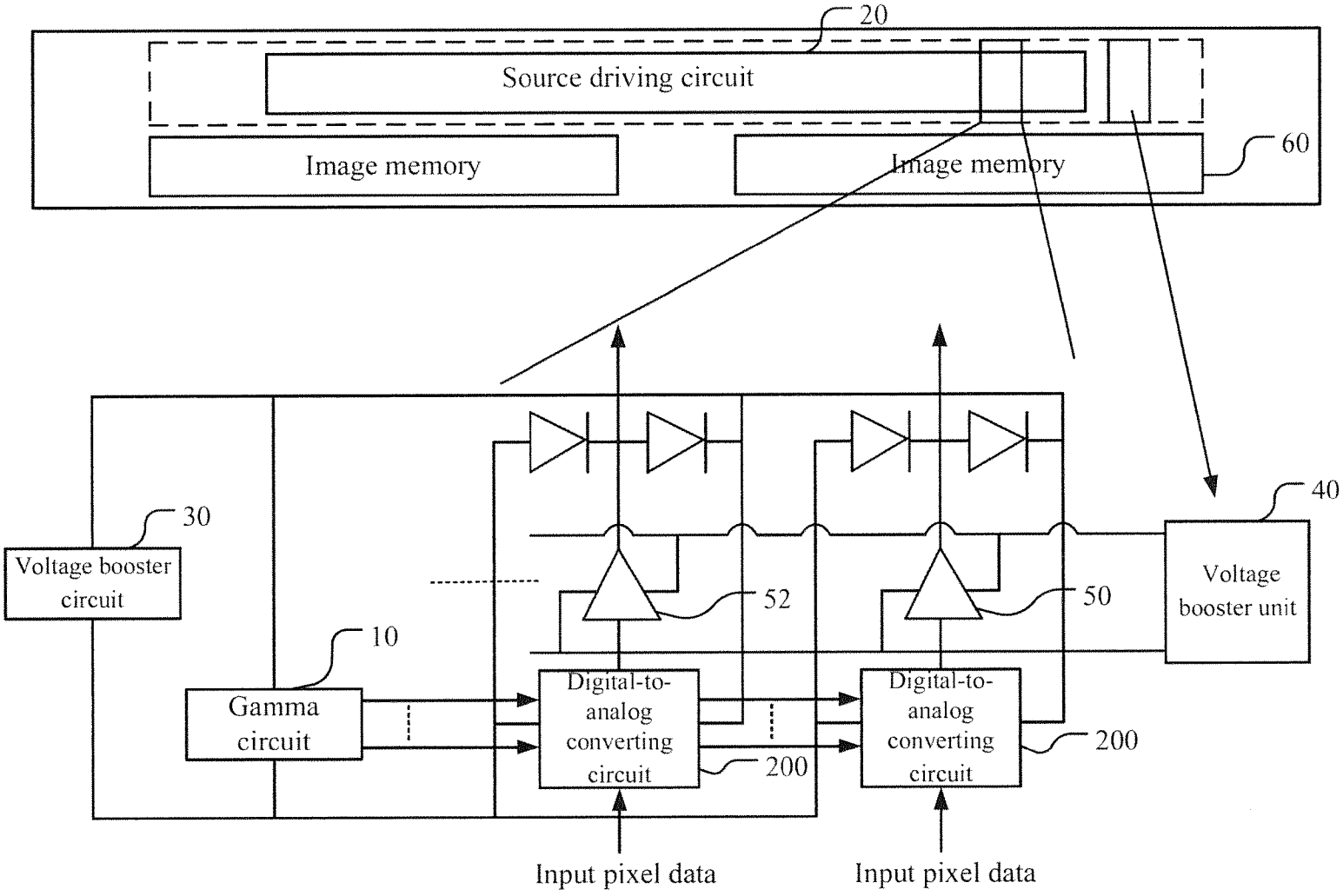
FIG. 5 shows a circuit diagram of the driving circuit according to another preferred embodiment of the present invention.

FIG. 5 shows a circuit diagram of the driving circuit according to another preferred embodiment of the present invention. As shown in the figure, the difference between the present embodiment and the previous one is that a voltage booster unit 40 according to the present embodiment not only provides voltage for a single driving unit but can also voltage for two or three driving units. As shown in FIG. 5, the voltage booster unit 40 according to the present embodiment is coupled to a first driving unit 50 and a second driving unit 52. The voltage booster unit 40 produces supply voltage to the first and the second driving units 50, 52 for supplying the power they need. Thereby, the area for the storage capacitor can be reduced or even no storage capacitor is required, and hence achieving the purpose of saving the circuit area. In addition, the number of the driving units can be reduced, and hence achieving the purposes of saving circuit areas as well costs. Furthermore, the voltage booster unit 40 according to the present embodiment can be disposed on the top boundary of the side of the driving unit 50 and located above the image memories 60.

Figure 6:
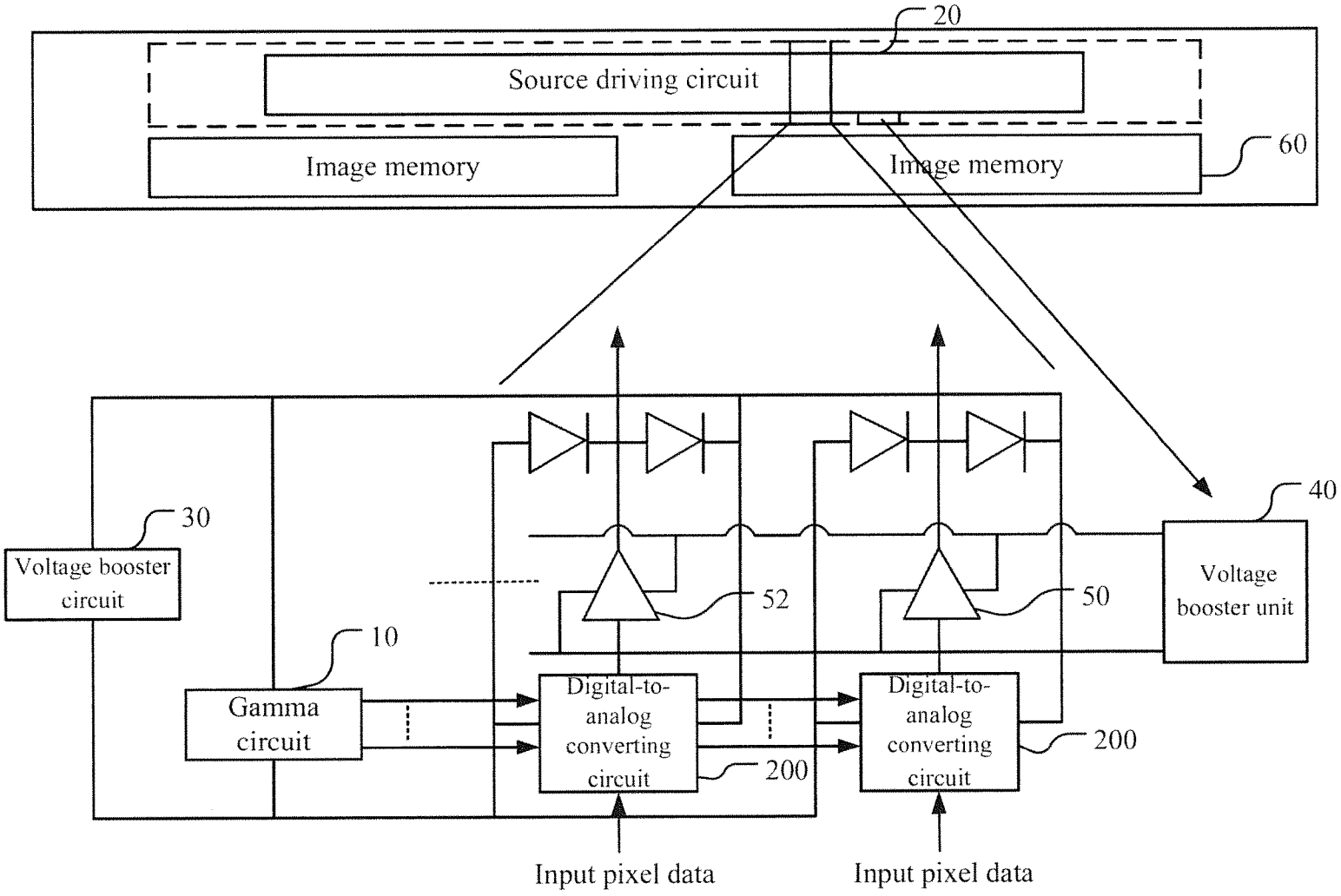
FIG. 6 shows a circuit diagram of the driving circuit according to another preferred embodiment of the present invention.

FIG. 6 shows a circuit diagram of the driving circuit according to another preferred embodiment of the present invention. As shown in the figure, the difference between the present embodiment and the one in FIG. 5 is that the voltage booster unit 40 according to the present embodiment can be arranged from one voltage booster unit supplying power for multiple driving units to at least one voltage booster unit supplying power for one driving unit (as the voltage boost units shown in FIG. 4). Thereby, the circuit of the voltage boost units 40 can be arranged along with the circuits of the driving units 50, 52 between the boundary of the side chips of the source driver 20 and the image memories 60.

Figure 7:
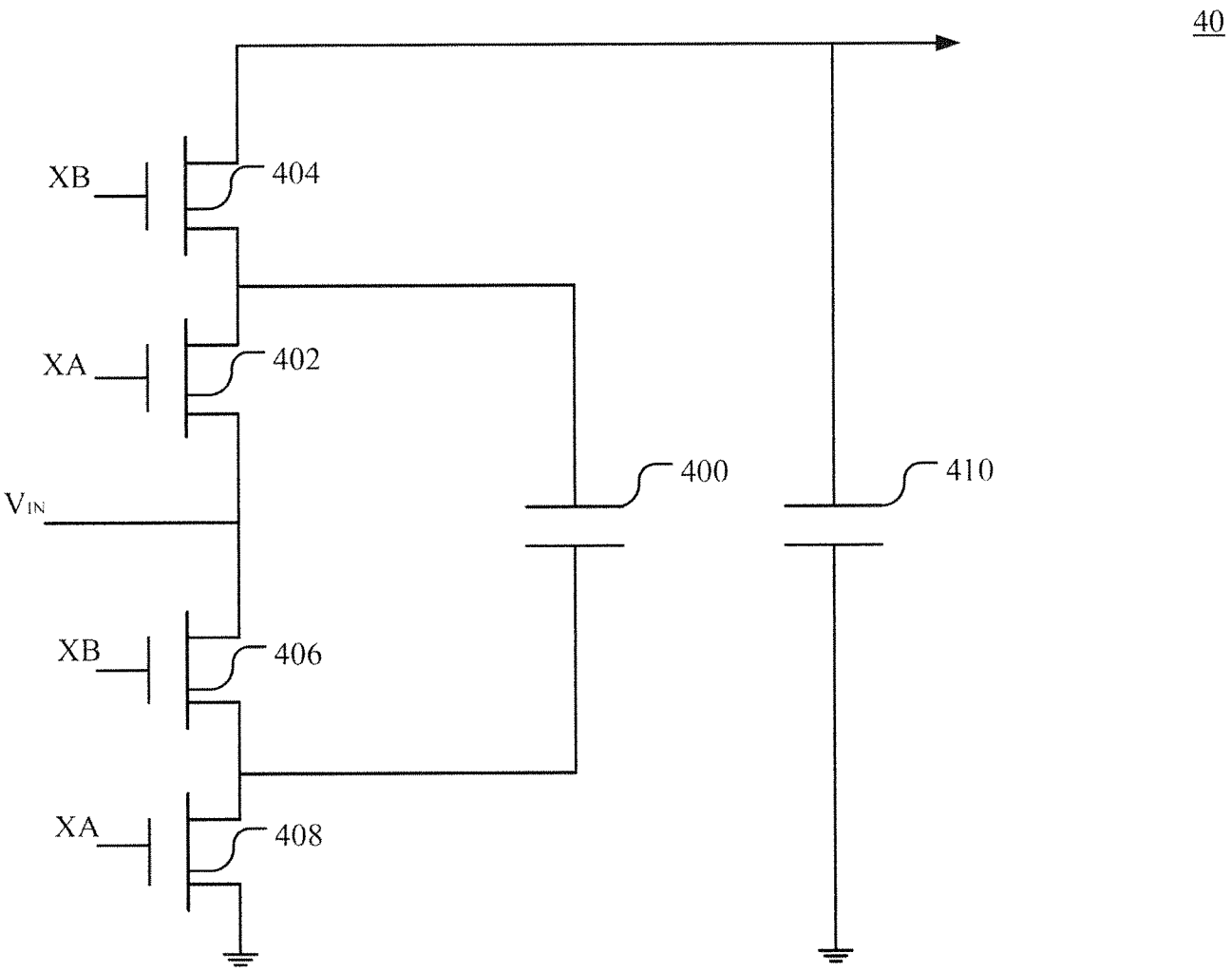
FIG. 7 shows a circuit diagram of the voltage booster unit according to a preferred embodiment of the present invention.

FIG. 7 shows a circuit diagram of the voltage booster unit according to a preferred embodiment of the present invention. As shown in the figure, the voltage booster unit 40 according to the present invention can be a capacitive voltage booster circuit, and comprises a flying capacitor 400, a first transistor 402, a second transistor 404, a third transistor 406, a fourth transistor 408, and a storage capacitor 410. The flying capacitor 400 is used for producing the supply voltage. One terminal of the first transistor 402 is coupled to the one terminal of the flying capacitor 400. Another terminal of the first transistor 402 receives an input voltage $V_{IN}$ and is controlled by a first control signal XA.

The second transistor 404 is coupled to the flying capacitor 400 and the first transistor 402 and controlled by a second control signal XB for outputting the supply voltage. One terminal of the third transistor 406 is coupled to the other terminal of the flying capacitor 400. Another terminal of the third transistor 406 receives the input voltage $V_{IN}$ and is controlled by the second control signal XB. One terminal of the fourth transistor 408 is coupled to the flying capacitor 400 and the third transistor 406. Another terminal of the fourth transistor 408 is coupled to the ground and controlled by the first control signal XA. One terminal of the storage capacitor 410 is coupled to the second transistor 404. The other terminal of the storage capacitor 410 is coupled to the ground for storing and outputting the supply voltage. Thereby, after the voltage booster unit 40 according to the present embodiment receives the input voltage $V_{IN}$, the first and the second control signals XA, XB are used for controlling the first to the fourth transistors 402, 404, 406, 408 for producing and outputting the supply voltage to the driving units 50, 52.

Figure 8:
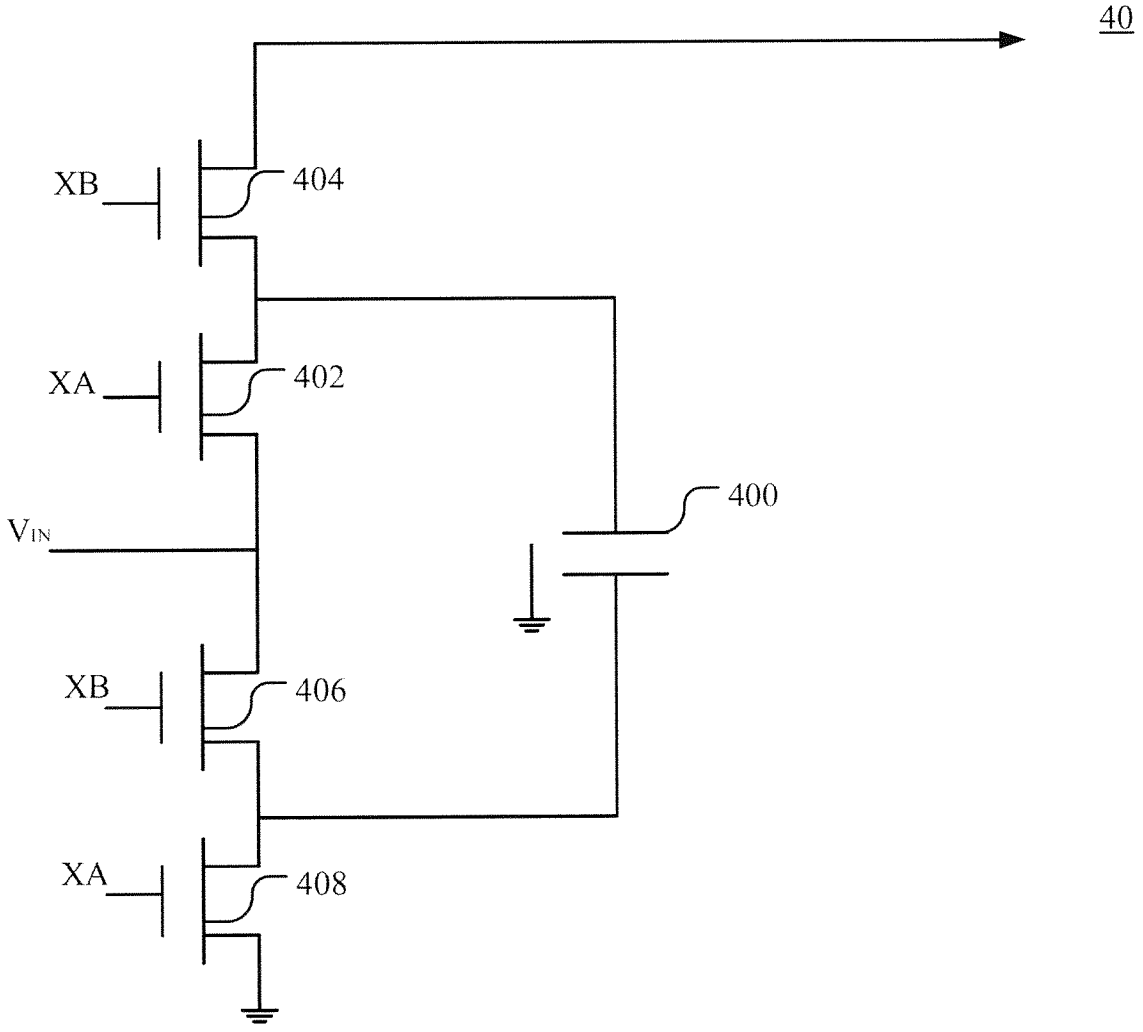
FIG. 8 shows a circuit diagram of the voltage booster unit according to another preferred embodiment of the present invention.

FIG. 8 shows a circuit diagram of the voltage booster unit according to another preferred embodiment of the present invention. As shown in the figure, the difference between the present embodiment and the one in FIG. 7 is that the voltage booster unit 40 according to the present embodiment needs no storage capacitor 410. Because the voltage booster unit 40 according to the present invention is used for providing the supply voltage for the driving units 50, 52, which only drive the panel (such as the display panel 2 in FIG. 4) but do not have the function of maintaining an accurate reference voltage for the digital-to-analog converting circuit (such as the digital-to-analog converting circuit 200 in FIG. 4), the power supply is allowed to oscillate significantly under the circumstance of no storage capacitor. Thereby, the voltage booster unit 40 according to the present embodiment needs only the flying capacitor 400 but not the storage capacitor for producing the supply voltage and supplying the power required by the driving units 50, 52. Accordingly, the purpose of reducing the circuit area and hence the costs can be achieved.

Figure 9:
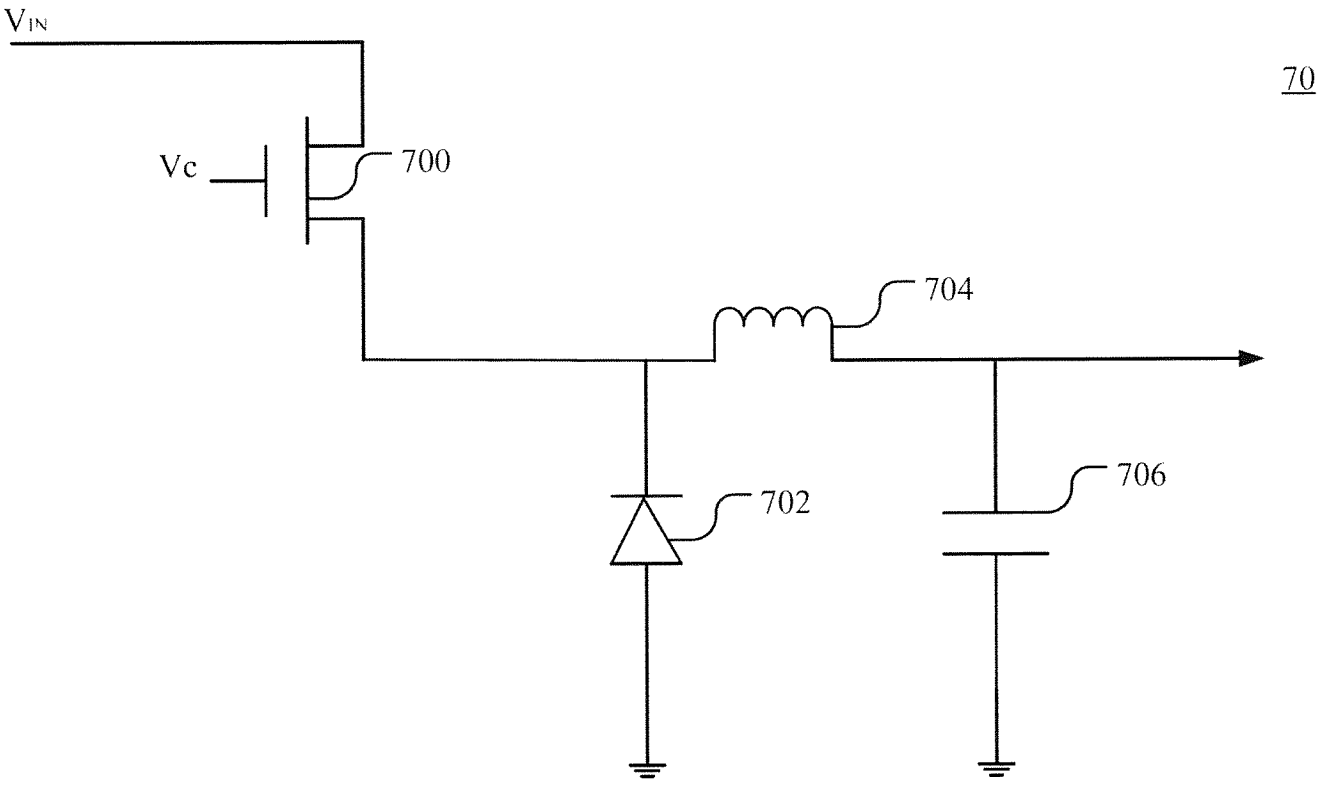
FIG. 9 shows a circuit diagram of the voltage booster unit according to another preferred embodiment of the present invention.

FIG. 9 shows a circuit diagram of the voltage booster unit according to another preferred embodiment of the present invention. As shown in the figure, the difference between the voltage booster unit 70 according to the present embodiment and the voltage booster units 40 in FIG. 7 and FIG. 8 is that that voltage booster unit 70 according to the present embodiment is an inductive voltage booster unit. The voltage booster unit 70 according to the present embodiment comprises a control transistor 700, a diode 702, a storage inductor 704, and an output capacitor 706. One terminal of the control transistor 700 receives the input voltage $V_{IN}$ and is controlled by a control signal $V_C$. One terminal of the diode 702 is coupled to the control transistor 700 while the other terminal thereof is coupled to the ground. The storage inductor 704 is coupled to the control transistor 700 and the diode 702 for storing the energy of eh input voltage $V_{IN}$. One terminal of the output capacitor 706 is coupled to the storage inductor 704 while the other terminal thereof is coupled to the ground for storing the energy of eh input voltage $V_{IN}$ and producing the supply voltage and outputting tot eh driving units 50, 52.

To sum up, the area-saving driving circuit for a display panel according to the present invention comprises a plurality of digital-to-analog converting circuits, a plurality of driving units, and a plurality of voltage booster units. The plurality of digital-to-analog converting circuits convert input data, respectively, and produce a pixel signal. The plurality of driving units are coupled to the plurality of digital-to-analog converting circuits, respectively. They produce a driving signal according to the pixel signal and transmit the driving signal to the display panel for displaying. In addition, the plurality of voltage booster units are coupled to the plurality of driving units, respectively, and produce a supply voltage according to a control signal. Then the supply voltage is provided to the plurality of driving units. Thereby, by providing the supply voltage to the plurality of driving units of the display panel by means of the plurality of voltage booster units, the area of the external storage capacitor is reduced. Alternative, the external storage capacitor can be even not required. Hence, the purpose of saving circuit area can be achieved.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

What is claimed is:

1. A driving circuit, connecting to a voltage booster circuit coupled with a storage capacitor, for a display panel, comprising:

a plurality of digital-to-analog converting circuits, converting input pixel data and producing a pixel signal, respectively;

a plurality of driving units, coupled to said plurality of digital-to-analog converting circuits, respectively, producing a driving signal according to said pixel signal, and transmitting said driving signal to said display panel for displaying; and a plurality of voltage booster units, coupled to said plurality of driving units, respectively, producing a first supply voltage, and providing said first supply voltage to said plurality of driving units, respectively;

wherein said voltage booster circuit, independent of said voltage booster units, coupled to said plurality of digital-to-analog converting circuits, and producing and providing a second supply voltage to said plurality of digital-to-analog converting circuits; and wherein said storage capacitor is coupled to said voltage booster circuit for stabilizing said second supply voltage.

2. The driving circuit of claim 1, wherein said plurality of voltage booster units produce said first supply voltage according to a control signal.

3. The driving circuit of claim 1, wherein said display panel comprises a plurality of pixel structures coupled to said plurality of driving units, respectively.

4. The driving circuit of claim 1, wherein said driving circuit is applied to a source driver of said display panel.

5. The driving circuit of claim 1, wherein said display panel is a thin-film transistor liquid crystal display.

6. The driving circuit of claim 1, wherein said plurality of driving units are operational amplifiers.

7. A driving circuit, connecting to a voltage booster circuit coupled with a storage capacitor, for a display panel, comprising:

a plurality of digital-to-analog converting circuits, converting input pixel data and producing a pixel signal, respectively;

a plurality of driving units, coupled to said plurality of digital-to-analog converting circuits, respectively, producing a driving signal according to said pixel signal, and transmitting said driving signal to said display panel for displaying;

at least one voltage booster unit, producing a first supply voltage, and providing said first supply voltage to a portion of said plurality of driving units;

wherein said voltage booster circuit, independent of said at least one voltage booster unit, coupled to said plurality of digital-to-analog converting circuits, and producing and providing a second supply voltage to said plurality of digital-to-analog converting circuits; and wherein said storage capacitor, coupled to said voltage booster circuit for stabilizing said second supply voltage.

8. The driving circuit of claim 7, wherein said voltage booster unit produces said first supply voltage according to a control signal.

9. The driving circuit of claim 7, wherein said voltage booster unit comprises:

a flying capacitor, used for producing said first supply voltage;

a first transistor, with one terminal coupled to one terminal of said flying capacitor and another terminal receiving an input voltage and controlled by a first control signal;

a second transistor, coupled to said flying capacitor and said first transistor, and controlled by a second control signal for outputting said first supply voltage;

a third transistor, with one terminal coupled to one terminal of said flying capacitor and another terminal receiving said input voltage and controlled by said second control signal; and a fourth transistor, with one terminal coupled to said flying capacitor and said third transistor and another terminal coupled to the ground and controlled by said first control signal.

10. The driving circuit of claim 9, wherein said voltage booster unit further comprises a storage capacitor, with one terminal coupled to said second transistor and the other terminal coupled to the ground for storing and outputting said first supply voltage.

11. The driving circuit of claim 7, wherein said voltage booster unit comprises:

a transistor, with one terminal receiving an input voltage, and controlled by a control signal;

a diode, with one terminal coupled to said transistor and the other terminal coupled to the ground;

a storage inductor coupled to said transistor and said diode for storing the energy of said input voltage; and an output capacitor, with one terminal coupled to said storage inductor and the other terminal coupled to the ground for storing the energy of said input voltage and producing and outputting said first supply voltage.

* * * * *